US008714700B2

(12) United States Patent
Inoue

(10) Patent No.: US 8,714,700 B2
(45) Date of Patent: May 6, 2014

(54) INKJET PRINTER

(75) Inventor: Ken Inoue, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/429,634

(22) Filed: Mar. 26, 2012

(65) Prior Publication Data

US 2012/0249672 A1 Oct. 4, 2012

(30) Foreign Application Priority Data

Mar. 29, 2011 (JP) ..... 2011-071867

(51) Int. Cl.
*B41J 2/165* (2006.01)

(52) U.S. Cl.
USPC ..... 347/32

(58) Field of Classification Search
USPC ..... 347/32
See application file for complete search history.

(56) References Cited

U.S. PATENT DOCUMENTS

| | | | | |
|---|---|---|---|---|
| 6,007,177 | A * | 12/1999 | Takanaka et al. | 347/28 |
| 6,158,838 | A * | 12/2000 | Capurso | 347/28 |
| 6,342,105 | B1 * | 1/2002 | Yano et al. | 134/42 |
| 6,682,165 | B2 * | 1/2004 | Yearout | 347/28 |
| 6,802,588 | B2 * | 10/2004 | Garbacz et al. | 347/28 |
| 7,753,474 | B2 * | 7/2010 | Hiruma et al. | 347/29 |
| 2002/0060713 | A1 * | 5/2002 | Katakura et al. | 347/30 |
| 2002/0122084 | A1 * | 9/2002 | Shihoh et al. | 347/7 |
| 2005/0168517 | A1 * | 8/2005 | Usuda | 347/29 |
| 2006/0274110 | A1 * | 12/2006 | Kang et al. | 347/33 |
| 2007/0081056 | A1 * | 4/2007 | Ito | 347/85 |
| 2009/0021564 | A1 * | 1/2009 | Seino et al. | 347/85 |
| 2010/0147891 | A1 | 6/2010 | Yoshihisa | |
| 2010/0302309 | A1 * | 12/2010 | Hatta et al. | 347/32 |

FOREIGN PATENT DOCUMENTS

| | | | |
|---|---|---|---|
| JP | 2001-018408 | A | 1/2001 |
| JP | 2001-138540 | A | 5/2001 |
| JP | 2009-226718 | A | 10/2009 |

* cited by examiner

*Primary Examiner* — Stephen Meier
*Assistant Examiner* — Alexander D Shenderov
(74) *Attorney, Agent, or Firm* — Lowe Hauptman & Ham, LLP

(57) ABSTRACT

An inkjet printer has a valve unit in a moisture supply path that connects a moisture tank and the fluid nozzles of a moisture discharge head. The moisture discharge head has an operating lever for opening and closing the valve unit, and when the cap approaches the moisture discharge head to seal the fluid nozzle faces of the moisture discharge head, a wiper unit that moves with the cap depresses the operating lever and opens the valve unit. Because the valve unit is open while the fluid nozzle faces are sealed by the cap, moisture leakage and backflow are suppressed.

9 Claims, 8 Drawing Sheets

INKJET PRINTER

RELATED APPLICATIONS

The present application is based on, and claims priority from, Japanese Application Number 2011-071867, filed Mar. 29, 2011, the disclosure of which is hereby incorporated by reference herein in its entirety.

BACKGROUND

1. Technical Field

The present invention relates to an inkjet printer that has a cap to cover the ink nozzle face of the inkjet head, and a moisture supply mechanism that supplies a moisturizing fluid into the cap.

2. Related Art

In order to prevent an increase in the viscosity of ink in the ink nozzles from clogging the ink nozzles, inkjet printers cover the ink nozzle face in which the ink nozzles are formed with a cap while the inkjet head is at the maintenance position to suppress evaporation of moisture from the ink nozzles. A flushing operation that ejects ink from the ink nozzles into the cap while the cap is opposite the ink nozzle face is also regularly performed to suppress nozzle clogging. When ink nozzle clogging occurs, an ink suction operation that covers the ink nozzle face with a cap, produces negative pressure in the sealed space formed between the nozzle face and the cap by means of a suction pump, and forcibly expels ink from the ink nozzles into the cap, is performed to eliminate the clogging. The ink expelled from the ink nozzles in the flushing operation and ink suction operation is absorbed by an ink-absorbent material (referred to below as a sponge) such as felt held inside the cap.

A humectant such as glycerin is contained in the ink that is ejected from the ink nozzles, and as the flushing operation and ink suction operation are performed, the humectant accumulates in the sponge inside the cap. If moisture then evaporates from inside the cap and the balance between the moisture in the cap and the amount of humectant is lost, the humectant will absorb moisture from the sealed space formed by the cap and the ink nozzle face when the ink nozzle face is covered by the cap, thus accelerating evaporation of moisture from the ink nozzles and promoting increased ink viscosity. As a result, the ink nozzles become easily clogged.

To prevent this from happening, Japanese Unexamined Patent Appl. Pub. JP-A-2009-226719 teaches an inkjet printer that has a moisture supply mechanism to supply moisture into the cap. The moisture supply mechanism in JP-A-2009-226719 has a moisture tank, a moisture discharge head with a fluid nozzle face in which a fluid nozzle for discharging moisture is formed, a moisture supply path that connects the moisture tank and the fluid nozzle, and a suction pump. When the fluid nozzle face is covered by the cap, the suction pump produces negative pressure in the sealed space formed between the cap and the fluid nozzle face, and forcibly discharges moisture supplied from the moisture tank from the moisture discharge head to the cap.

The moisture supply mechanism described in JP-A-2009-226719 does not require a mechanism that ejects moisture into the moisture discharge head itself. Moisture can also be discharged from the moisture discharge head using the suction pump that is used for the ink suction operation. The cost of manufacturing an inkjet printer with the moisture supply mechanism can therefore be suppressed. However, leakage of moisture from the moisture discharge head or backflow of the moisture in the moisture supply path could occur depending on the location of the moisture tank. If the moisture leaks, the inside of the printer could become wet. If moisture backflow occurs, the amount of moisture discharged into the cap by the suction operation of the suction pump will be unstable, and the moisture level inside the cap cannot be kept at the desired level.

If a part with a small diameter is formed in the fluid nozzle, the moisture can be prevented from leaking or backflowing by the pressure resistance of the meniscus of the moisture in the fluid nozzle. However, if the diameter of the fluid nozzle is on the order of several ten microns, a hydraulic head of several hundred millimeters cannot be withstood, manufacturing the moisture discharge head is therefore more difficult, and the product manufacturing cost increases.

SUMMARY

An inkjet printer according to the present invention can suppress or prevent wetting by moisture from a moisture discharge head and backflow of the moisture.

One aspect of the invention is an inkjet printer including: an inkjet head that can move between a printing position and a maintenance position; a cap that seals the ink nozzle face of the inkjet head set to the maintenance position; a cap moving mechanism that moves the cap; and a moisture supply mechanism that supplies moisture to the inside of the cap. The moisture supply mechanism includes a moisture discharge head with a fluid nozzle face in which a fluid nozzle for discharging the moisture is formed; a valve disposed in a moisture supply path connecting a moisture tank with the fluid nozzle; and a valve operating mechanism that holds the valve closed when the fluid nozzle face is not covered by the cap, and opens the valve when the fluid nozzle face is sealed by the cap. The cap moving mechanism moves the cap between a capping position sealing the ink nozzle face of the inkjet headset to the maintenance position, or the fluid nozzle face of the moisture discharge head set to the maintenance position, and a capping standby position removed from the capping position. The valve operating mechanism holding the valve closed when the cap is at the capping standby position, and opening the valve when the cap is at the capping position.

This aspect of the invention can perform the opening operation of the valve located in the moisture supply path together with the operation moving the cap to seal the moisture discharge head. More specifically, the valve is opened by the valve operating mechanism only when the fluid nozzle face of the moisture discharge head is sealed by the cap, and closed when the fluid nozzle face is not covered by the cap. Leakage of moisture from the moisture discharge head, and backflow of moisture from the moisture discharge head to the moisture tank side can be prevented or reduced.

Preferably, the moisture supply mechanism includes a moisture discharge head moving mechanism that moves the moisture discharge head to the maintenance position when the inkjet head is at the printing position, and seals the fluid nozzle face with the cap; and a suction mechanism that produces negative pressure in a sealed space formed by the fluid nozzle face and the cap, and discharges moisture from the fluid nozzle, when the fluid nozzle face is sealed by the cap and the valve is open.

In another aspect of the invention, the valve operating mechanism includes a valve switch that is supported on the moisture discharge head slidably between a closed position for closing the valve and an open position for opening the valve, and a pushing member that, when the cap moves from the capping standby position to the capping position and approaches the moisture discharge head set to the maintenance position, approaches the moisture discharge head with the cap and pushes the valve switch in a depression direction from the closed position to the open position.

Further preferably in another aspect of the invention, the valve operating mechanism includes a first spring member that supports the valve switch at the closed position, and urges the valve switch to the closed position side when the valve switch is pushed from the closed position to the open position, and when the cap moves from the capping position toward the capping standby position and the pushing member separates from the moisture discharge head, the valve switch is pushed back from the open position to the closed position by a first urging force of the first spring member.

This configuration can perform the closing operation that closes the valve in conjunction with the operation moving the cap away from the moisture discharge head.

An inkjet printer according to another aspect of the invention preferably also has: a wiper unit with a wiper for wiping the ink nozzle face of the inkjet head at the maintenance position, or the fluid nozzle face of the moisture discharge head at the maintenance position; a wiper unit moving mechanism that moves the wiper unit parallel to the ink nozzle face or the fluid nozzle face; and a linking mechanism that connects the wiper unit and the moisture discharge head; and the moisture discharge head moving mechanism moves the moisture discharge head between the maintenance position and a maintenance standby position separated from the maintenance position by moving the wiper unit while the wiper unit and the moisture discharge head are connected by the linking mechanism.

More specifically, by using the wiper unit moving mechanism that moves the wiper unit for the moisture discharge head moving mechanism, the moisture discharge head moving mechanism can be easily configured and the product manufacturing cost can be suppressed.

An inkjet printer according to another aspect of the invention preferably also has a frame on which the cap, wiper unit, and wiper unit moving mechanism are mounted. The cap moving mechanism moves the cap between the capping position and the capping standby position by moving the frame, and the pushing member is the wiper unit, and can depress the valve switch when the wiper unit is set to a specific pushing position by the wiper unit moving mechanism.

When the cap moves from the capping standby position toward the capping position and seals the fluid nozzle face of the moisture discharge head set to the maintenance position in this aspect of the invention, the valve can be opened by moving the wiper unit to the pushing position. In addition, if the wiper unit is set to a position separated from the pushing position, the fluid nozzle face can be sealed by the cap while the valve is held closed.

Further preferably in an inkjet printer according to another aspect of the invention, the valve includes a valve seat in which an orifice for opening and closing the moisture supply path is disposed, a disc that moves in a direction toward and a direction away from the valve seat, and opens and closes the orifice, a second spring member that urges the disc to the valve seat, and a magnetic attraction mechanism that moves the disc in a direction away from the valve seat against the urging force of the second spring member, has either a magnetic body or a magnet mounted on the disc, and the other of the magnetic body or magnet mounted the valve switch, and when the valve switch is depressed to the open position, the magnet and magnetic body approach and the force of magnetic attraction working between the magnet and magnetic body separates the disc from the valve seat and opens the orifice, and when the valve switch moves from the open position to the closed position, the urging force of the second spring member seats the disc on the valve seat and closes the orifice.

This enables opening and closing the valve by operating a valve switch.

Effect of the Invention

A valve located in a moisture supply path is opened only when the fluid nozzle face of a moisture discharge head is sealed with a cap by the valve operating mechanism, and is closed when the fluid nozzle face is not covered by the cap. Leakage of moisture from the moisture discharge head, and backflow of moisture from the moisture discharge head to the moisture tank side can therefore be prevented or reduced.

Other objects and attainments together with a fuller understanding of the invention will become apparent and appreciated by referring to the following description and claims taken in conjunction with the accompanying drawings.

DESCRIPTION OF EMBODIMENTS

An inkjet printer according to a preferred embodiment of the invention is described below with reference to the accompanying figures.

General Configuration

Figure 1:
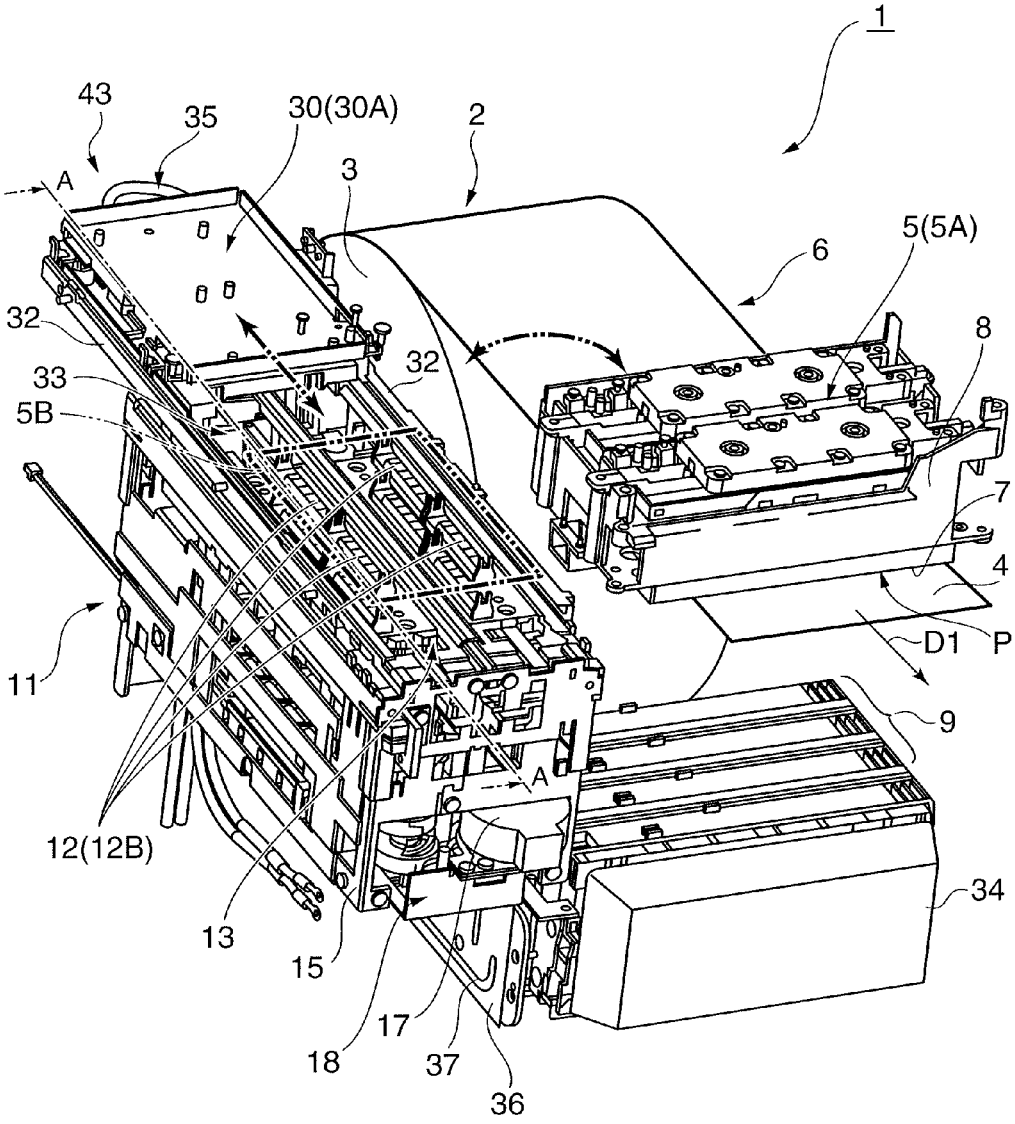
FIG. 1 is an oblique view of an inkjet printer without the printer case.
Figure 2A:
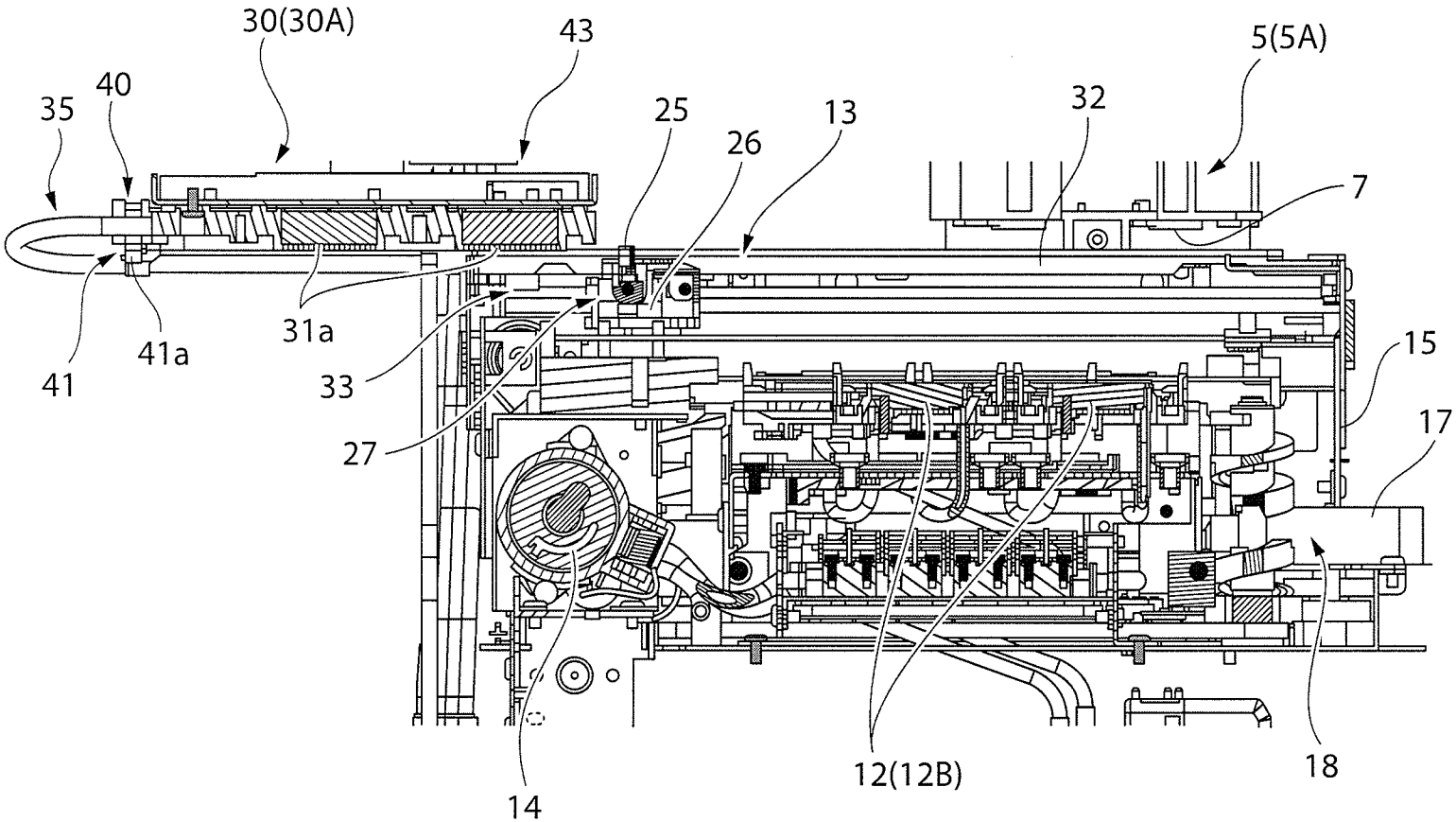
FIG. 2 is a section view through line A-A in FIG. 1.
Figure 2B:
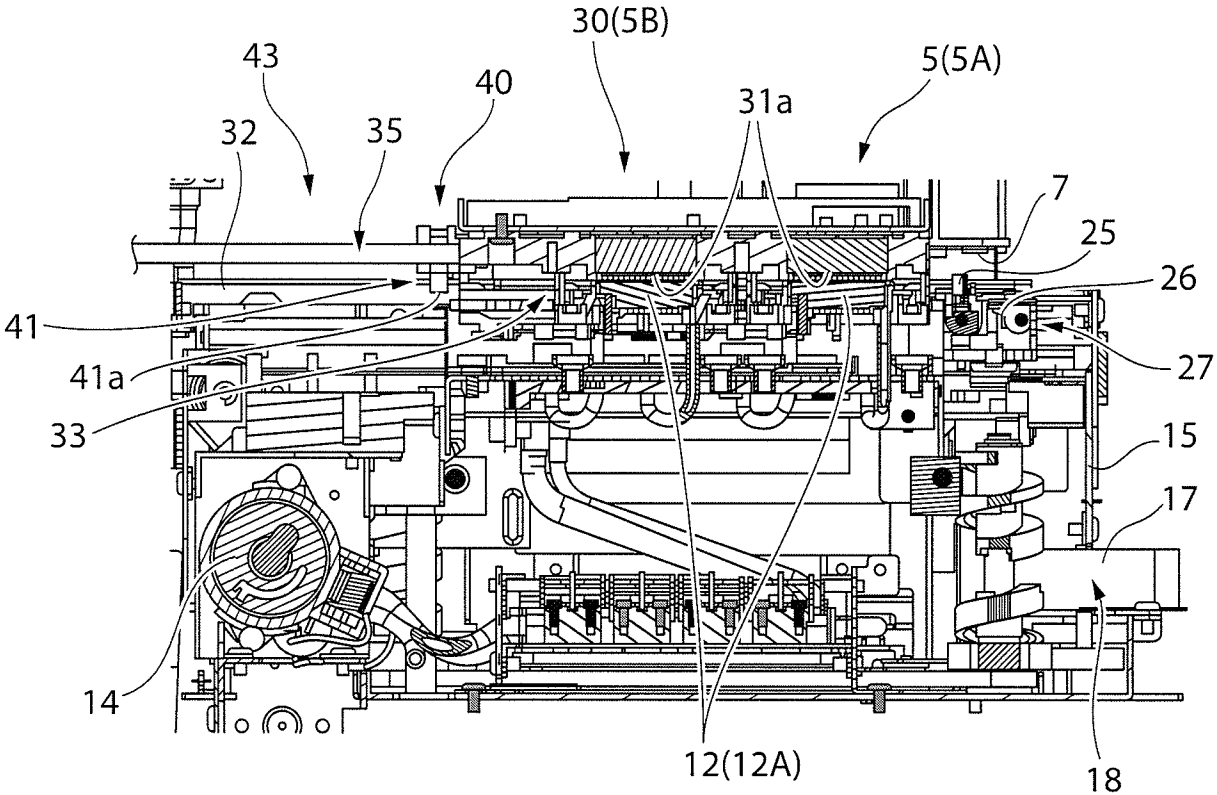
Figure 3:
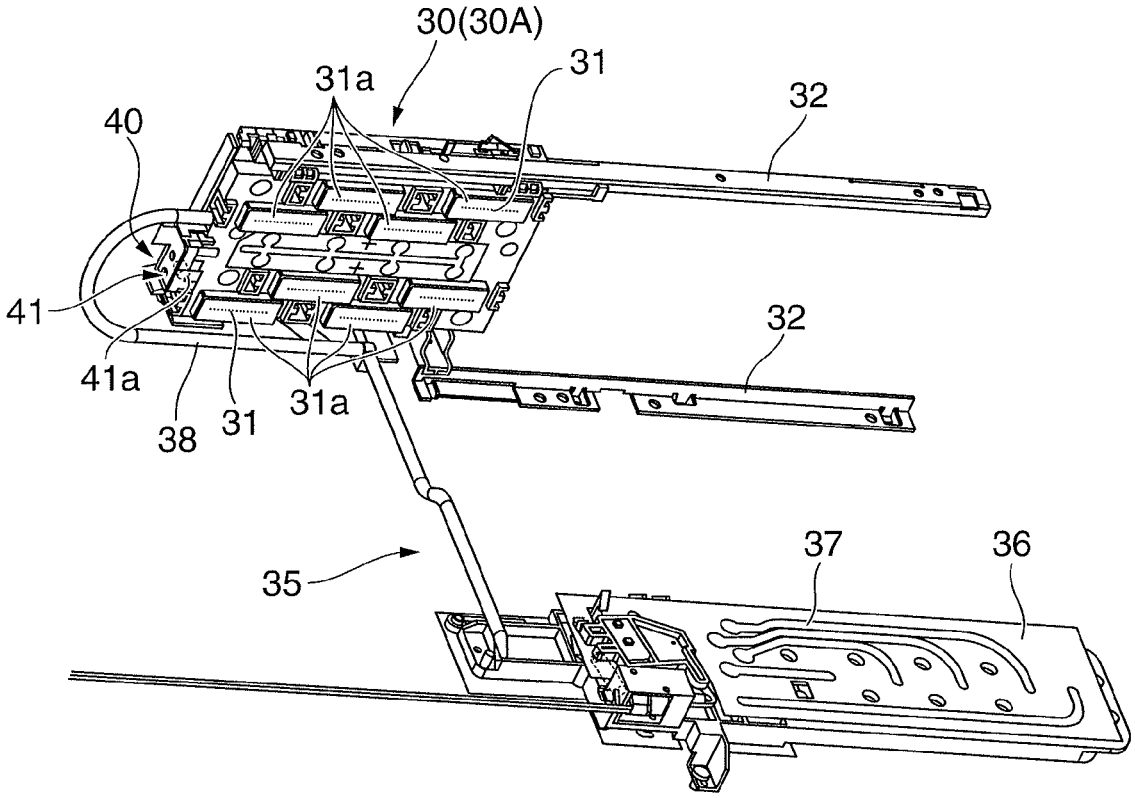
FIG. 3 is an oblique view of the moisture discharge head, moisture supply path, and guide rail.

FIG. 1 is an oblique view showing main parts of an inkjet printer according to this embodiment of the invention with the printer case removed. FIG. 2 is a section view through line A-A in FIG. 1, FIG. 2A showing the moisture discharge head at the maintenance standby position, and FIG. 2B showing the moisture discharge head at the maintenance position. FIG. 3 is an oblique view of the moisture discharge head, moisture supply path, and guide rail from below the back of the printer.

As shown in FIG. 1, the inkjet printer 1 conveys recording paper 4 pulled from a paper roll 3 stored in a roll paper compartment 2 at the back of the printer in a conveyance direction D1 toward the front of the printer along a roll paper conveyance path 6 past the printing position P of the inkjet head 5, and prints. The inkjet head 5 is mounted on a carriage 8 with the ink nozzle faces 7 in which the ink nozzles are formed facing down, and rotates between a printing position 5A indicated by a solid line in FIG. 1 and the maintenance position 5B position indicated by the double-dot dash line. An ink supply mechanism (not shown in the figure) for supplying ink from an ink tank 9 located below the printing position P is connected to the inkjet head 5, and printing to the recording paper 4 passing the printing position P is possible when the inkjet head 5 is at the printing position 5A. The maintenance position 5B is offset to the side of the roll paper compartment 2 and the roll paper conveyance path 6.

A head maintenance unit 11 is located below the maintenance position 5B. The head maintenance unit 11 includes a cap 12 that seals the ink nozzle faces 7 of the inkjet head 5 at the maintenance position 5B, wiper mechanism 13 that wipes the ink nozzle faces 7 of the inkjet head 5 at the maintenance position 5B, and suction pump 14 (suction device, FIG. 2) that performs an ink suction operation that forcibly discharges ink from the cap 12. The cap 12, wiper mechanism 13, and suction pump 14 are mounted on a unit frame 15. The unit frame 15 is supported movably vertically on a base frame 16 (see FIG. 4), and moves up and down on the base frame 16 by means of a lift mechanism 18 (cap moving mechanism) with a drive motor 17.

A lip made of butyl rubber, for example, is formed around the circumference of the open edge of the cap 12, and an ink absorbent member (referred to herein as a sponge) made of felt or other suitable material for absorbing the ink ejected from the inkjet head 5 is held inside the cap 12. The cap 12 is supported on the unit frame 15 by a spring 21 (FIG. 4). As the unit frame 15 moves up and down, the cap 12 moves vertically between a capping position 12A where the ink nozzle faces 7 of the inkjet head 5 are sealed at the maintenance position 5B, and a capping standby position 12B separated down from the capping position 12A.

The wiper mechanism 13 has a wiper unit 26 that carries a wiper 25, and a wiper unit moving mechanism 27 that moves the wiper unit 26 in the direction between the front and back of the printer (referred to as the longitudinal direction) parallel to the ink nozzle faces 7 (FIG. 2). When the top edge of the wiper 25 is set by the vertical movement of the unit frame 15 to the wiping position (not shown in the figure) where the wiper 25 can slide against the ink nozzle faces 7, the wiper mechanism 13 moves the wiper unit 26 in the longitudinal direction by means of the wiper unit moving mechanism 27, and wipes the ink nozzle faces 7 with the wiper 25.

When the ink nozzle faces 7 are sealed by the cap 12, the suction pump 14 produces negative pressure in the sealed space formed by the ink nozzle faces 7 and cap 12 at a specific time, and discharges ink from the ink nozzles.

A moisture discharge head 30 that supplies moisture into the cap 12 is disposed behind the maintenance position 5B. The moisture is water or a solution of water and a preservative.

As shown in FIG. 2 and FIG. 3, the moisture discharge head 30 is mounted on a pair of guide rails 32 that extend in the longitudinal direction with the fluid nozzle faces 31*a* in which the fluid nozzles 31 that discharge the moisture are formed facing down. The moisture discharge head 30 is moved by a moisture discharge head moving mechanism 33 along the guide rails 32 between the maintenance position 5B and a maintenance standby position 30A removed to the back of the printer from the maintenance position 5B. The moisture discharge head 30 is at the maintenance standby position 30A in FIG. 1 and FIG. 2A, and in FIG. 2B the moisture discharge head 30 is at the maintenance position 5B. The inkjet head 5 and moisture discharge head 30 are selectively set to the maintenance position 5B. The moisture discharge head moving mechanism 33 is rendered using the wiper mechanism 13.

The fluid nozzle faces 31*a* of the moisture discharge head 30 have the same shape as the ink nozzle faces 7 of the inkjet head 5. Therefore, when the moisture discharge head 30 is set by the moisture discharge head moving mechanism 33 to the maintenance position 5B, the fluid nozzle faces 31*a* can be sealed by the cap 12 moving to the capping position 12A. In addition, when the wiper mechanism 13 is set to the wiping position after the moisture discharge head 30 is moved to the maintenance position 5B, the fluid nozzle faces 31*a* of the moisture discharge head 30 can be wiped by the wiper mechanism 13.

A moisture tank 34 is located below the printing position P in front of the ink tank 9 (FIG. 1). The moisture tank 34 and the fluid nozzles 31 of the moisture discharge head 30 are connected by a moisture supply path 35. As shown in FIG. 3, the moisture supply path 35 includes from the downstream end a flat path 37 formed on a rigid substrate 36, a flexible tube 38, and an internal path 39 formed inside the moisture discharge head 30 (see FIG. 5). A valve unit (valve) 40 for opening and closing the moisture supply path 35 is disposed in the internal path 39. The valve unit 40 is disposed to the part of the moisture discharge head 30 towards the back of the printer.

A valve switch 41 that slides vertically and opens and closes the valve unit 40 is attached to the valve unit 40. The valve switch 41 is supported on the moisture discharge head 30 slidably between a closed position 40A (see FIG. 5B) for closing the valve unit 40, and an open position 40B (see FIG. 5C) for opening the valve unit 40. The operating part 41*a* of the valve switch 41 protrudes down from the moisture discharge head 30. The valve switch 41 renders a valve operating mechanism 42 that can hold the valve unit 40 closed when the fluid nozzle faces 31*a* of the moisture discharge head 30 are not covered by the wiper unit 26 of the wiper mechanism 13 and the cap 12, and open the valve unit 40 when the fluid nozzle faces 31*a* are sealed by the cap 12.

When the fluid nozzle faces 31*a* are sealed by the cap 12 and the valve unit 40 is opened by the valve operating mechanism 42, negative pressure can be produced in the sealed space formed by the fluid nozzle faces 31*a* and cap 12 by driving the suction pump 14, and moisture can be discharged from the fluid nozzles 31 into the cap 12. More specifically, the moisture discharge head 30, moisture discharge head moving mechanism 33, moisture tank 34, moisture supply path 35, valve unit 40, valve operating mechanism 42, and suction pump 14 render a moisture supply mechanism 43 that supplies moisture to the cap 12.

Moisture Discharge Head Moving Mechanism

FIG. 4 describes the moisture discharge head moving mechanism 33. The moisture discharge head moving mechanism 33 uses the wiper unit moving mechanism 27 and wiper unit 26 to move the moisture discharge head 30 between the maintenance position 5B and maintenance standby position 30A. The moisture discharge head moving mechanism 33 has a linking mechanism 45 that connects the wiper unit 26 and moisture discharge head 30.

The wiper unit moving mechanism 27 has a wiper unit guide shaft 46 that extends in the longitudinal direction below and between the pair of guide rails 32. The wiper unit guide shaft 46 extends parallel to the ink nozzle faces 7 of the inkjet head 5 and the fluid nozzle faces 31*a* of the moisture discharge head 30, and the front and back end parts are supported from below by a spring 47. The wiper unit 26 is attached to the wiper unit guide shaft 46 and moves in the longitudinal direction along the wiper unit guide shaft 46. A configuration that uses the wiper unit guide shaft 46 as a lead screw, and has a threaded hole in the wiper unit 26 that mates with the lead screw, can be used as the wiper unit moving mechanism 27.

The linking mechanism 45 includes a protruding part 48 that protrudes down from the bottom part of the front of the moisture discharge head 30, and a recess 49 disposed in the wiper unit 26 to engage the protruding part 48.

Figure 4A:
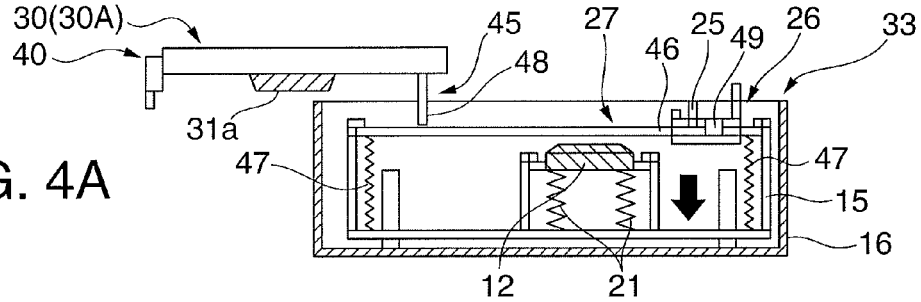
FIG. 4 shows the moisture discharge head moving mechanism.
Figure 4B:
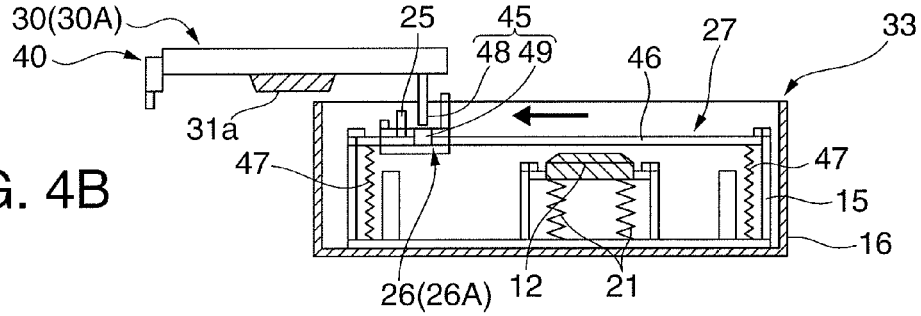
Figure 4C:
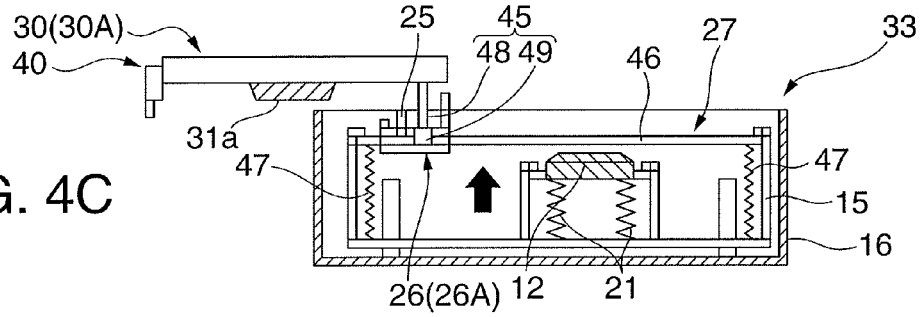
Figure 4D:
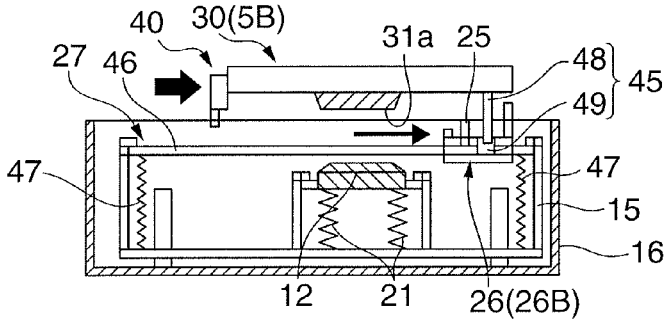
Figure 4E:
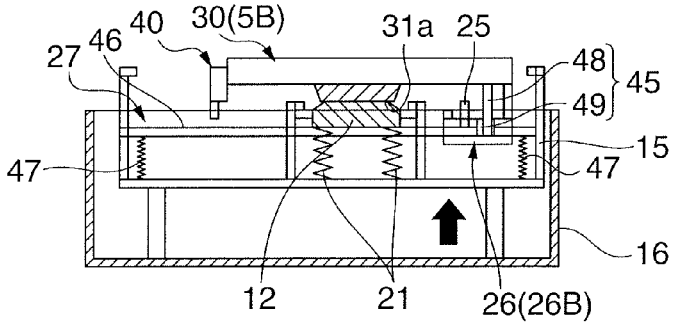

To move the moisture discharge head 30 from the maintenance standby position 30A shown in FIG. 4A to the maintenance position 5B shown in FIG. 4D and FIG. 4E, the moisture discharge head moving mechanism 33 first lowers the unit frame 15 by means of the lift mechanism 18 and sets the wiper mechanism 13 to a position where it will not interfere with the moisture discharge head 30. Next, as shown in FIG. 4B, the wiper unit moving mechanism 27 moves the wiper unit 26 toward the back of the printer to a first engagement position 26A where the recess 49 is positioned directly below the protruding part 48 of the moisture discharge head 30 at the maintenance standby position 30A. The lift mechanism 18 then raises the unit frame 15, causing the wiper unit 26 to rise, engaging the recess 49 of the wiper unit 26 and the protruding part 48 of the moisture discharge head 30, and connecting the wiper unit 26 and the moisture discharge head 30 as shown in FIG. 4C.

The wiper unit moving mechanism 27 then moves the wiper unit 26 toward the front of the printer. As a result, the moisture discharge head 30 connected to the wiper unit 26 moves to the maintenance position 5B as shown in FIG. 4D.

When the unit frame 15 is raised by the lift mechanism 18, the fluid nozzle faces 31*a* of the moisture discharge head 30 can be covered by the cap 12 as shown in FIG. 4E.

The above operation is reversed to move the moisture discharge head 30 from the maintenance position 5B to the maintenance standby position 30A. More specifically, if the moisture discharge head 30 and wiper unit 26 are disconnected, lowering the unit frame 15 by means of the lift mechanism 18 causes the wiper mechanism 13 to descend to a position not interfering with the moisture discharge head 30. Next, the wiper unit moving mechanism 27 moves the wiper unit 26 toward the printer front to the second engagement position 26B where the recess 49 is directly below the protruding part 48 of the moisture discharge head 30 at the maintenance standby position 30A. The wiper unit 26 is then raised by the lift mechanism 18 raising the unit frame 15, engaging the recess 49 in the wiper unit 26 with the protruding part 48 of the moisture discharge head 30. As a result, the wiper unit 26 and the moisture discharge head 30 are connected again as shown in FIG. 4D. The wiper unit moving mechanism 27 then moves the wiper unit 26 to the back of the printer. As a result, the moisture discharge head 30 engaged with the wiper unit 26 moves to the maintenance standby position 30A, returning to the position shown in FIG. 4C.

Valve Unit and Valve Operating Mechanism

Figure 5A:
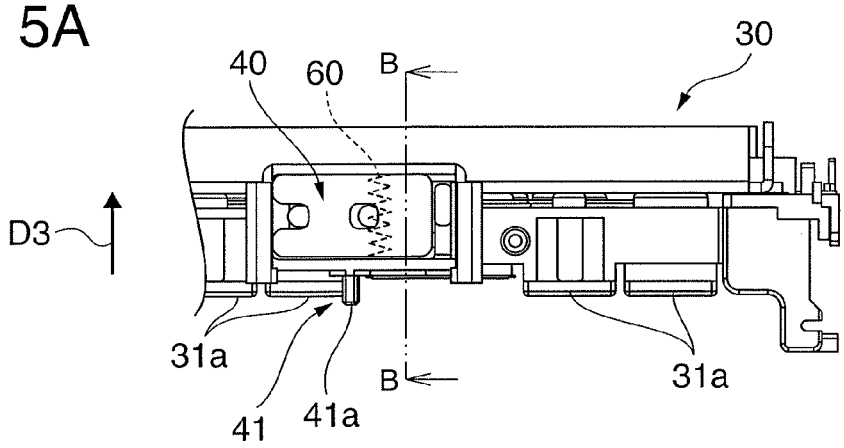
FIG. 5 shows a valve unit and valve operating mechanism.
Figure 5B:
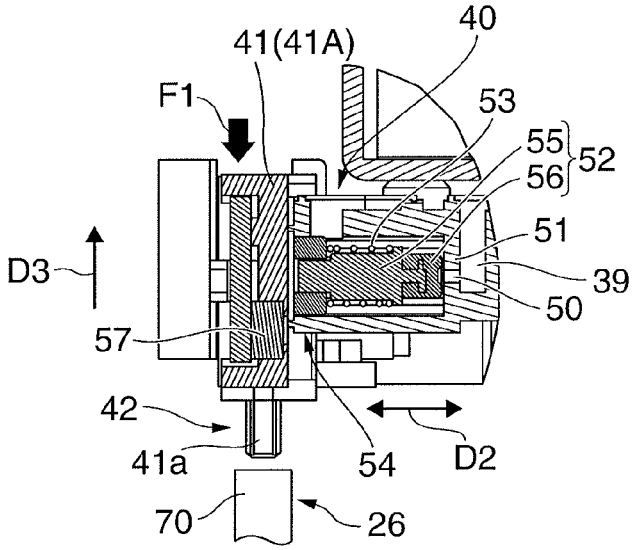
Figure 5C:
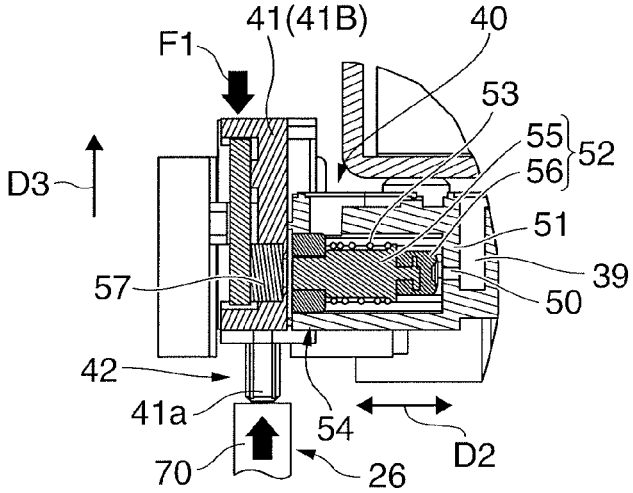
Figure 6A:
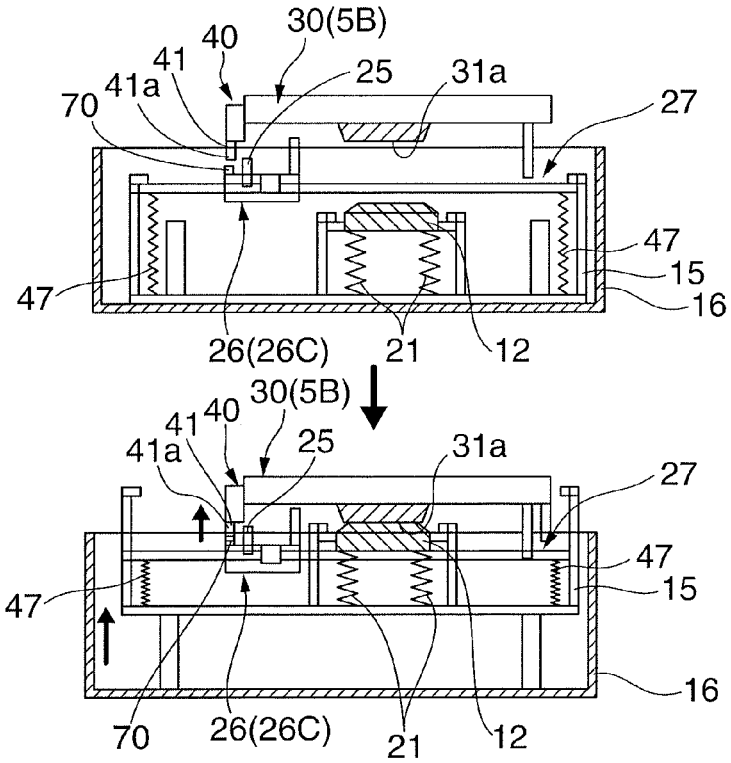
FIG. 6 describes the operation of opening and closing the valve unit.
Figure 6B:
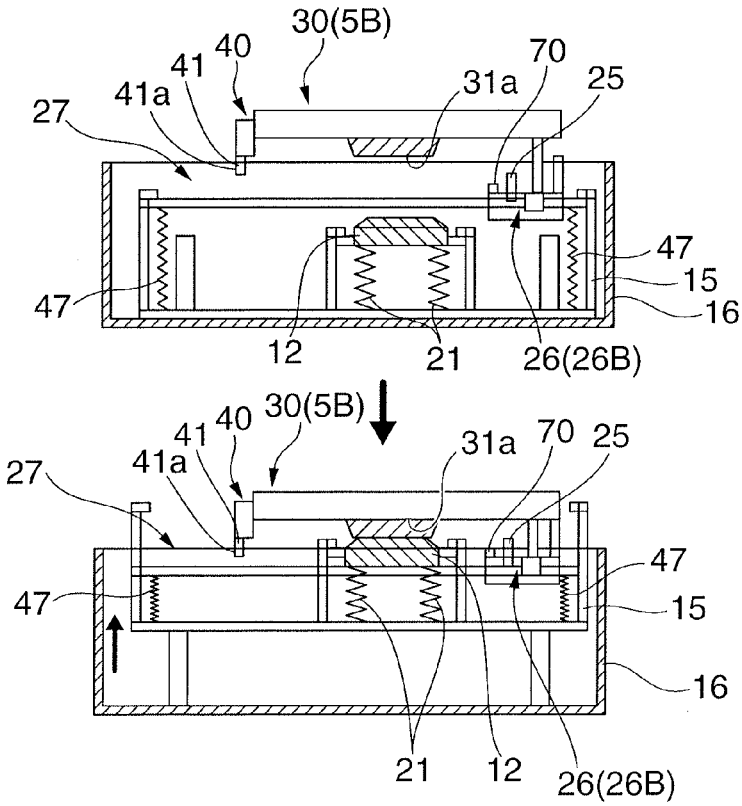

The valve unit 40 and valve operating mechanism 42 are described next with reference to FIG. 5. FIG. 5A is a partial back view of the moisture discharge head 30 from the back side of the printer. FIG. 5B and FIG. 5C are section views through line B-B in FIG. 5A, FIG. 5B showing the valve switch 41 at the closed position 41A, and FIG. 5C showing the valve switch 41 at the open position 41B. FIG. 6 describes the opening and closing operation of the valve unit 40, FIG. 6A showing the opening operation that opens the valve unit 40 in conjunction with the cap 12 sealing the fluid nozzle faces 31*a*, and FIG. 6B showing when the valve unit 40 is held in the closed position when the fluid nozzle faces 31*a* are sealed by the cap 12.

The valve unit 40 includes a valve seat 51 in which an orifice 50 of the internal path 39 is disposed for opening and closing the moisture supply path 35; a valve disc 52 that moves to and away from the valve seat 51 to close and open the orifice 50; a spring 53 (second spring member) that urges the valve disc 52 to the valve seat 51; and a magnetic attraction mechanism 54 that moves the valve disc 52 away from the valve seat 51 against the urging force of the spring 53.

The valve disc 52 includes a rod-shaped iron core (magnetic body) 55, and an elastic body 56 such as rubber attached to the distal end of the iron core 55, and opens and closes the orifice 50 by moving the elastic body 56 to and away from the valve seat 51. The spring 53 is a compression spring disposed around the iron core 55. The direction D2 of valve disc 52 movement is perpendicular to the direction D3 (vertical) in which the valve switch 41 is pushed.

The magnetic attraction mechanism 54 includes the iron core 55 of the valve disc 52, and a magnet 57 mounted on the valve switch 41. The magnet 57 is affixed to the valve switch 41, and moves vertically in conjunction with the valve switch 41. When the valve switch 41 reaches the top open position 41B, the magnet 57 and valve disc 52 are in mutual proximity, and the force of magnetic attraction between the magnet 57 and iron core 55 becomes stronger than the urging force of the spring 53. As a result, the valve disc 52 separates from the valve seat 51 due to the force of magnetic attraction, and the orifice 50 opens. More specifically, the valve unit 40 opens and the moisture supply path 35 opens. Because the distance between the magnet 57 and the valve disc 52 increases when the valve switch 41 moves from the open position 41B down to the closed position 41A, the urging force of the spring 53 becomes stronger than the force of magnetic attraction. As a result, the urging force of the spring 53 causes the valve disc 52 to contact the valve seat 51, and close the orifice 50. More specifically, the valve unit 40 closes and the moisture supply path 35 closes. Note that the magnetic attraction mechanism 54 could alternatively be rendered with the magnet 57 disposed to the disc, and a magnetic body disposed to the valve switch 41, which is nonmagnetic.

The valve operating mechanism 42 includes the valve switch 41, the wiper unit 26 (pushing member), a positioning member (not shown in the figure) that contacts the valve switch 41 from below and positions the valve switch 41 to the closed position 41A, and a spring 60 (first spring member) such as a coil spring that produces urging force F1 pushing the valve switch 41 down to the positioning member and supports the valve switch 41 at the closed position 41A. The positioning member and the spring 60 are disposed to the moisture discharge head 30.

As shown in FIG. 6, the wiper unit 26 has a protruding part 70 that protrudes up. When the wiper unit moving mechanism 27 sets the wiper unit 26 to a predetermined pushing position 26C, the protruding part 70 of the wiper unit 26 can contact the operating part 41*a* of the valve switch 41 of the moisture discharge head 30 at the maintenance position 5B. More specifically, when at the pushing position 26C, the protruding part 70 of the wiper unit 26 is positioned directly below the valve switch 41 of the moisture discharge head 30 at the maintenance position 5B.

As shown at the top in FIG. 6A, when the moisture discharge head 30 is at the maintenance position 5B, the wiper unit 26 is at the pushing position 26C, and the unit frame 15 rises until the cap 12 reaches the capping position 12A, the protruding part 70 of the wiper unit 26 that rises with the unit frame 15 contacts the valve switch 41 from the bottom as shown in the bottom in FIG. 6A, and pushes the valve switch 41 up in the depression direction D3 from the closed position 41A to the open position 41B. As a result, the fluid nozzle faces 31*a* are sealed by the cap 12 and the valve unit 40 opens.

When the unit frame 15 then descends from the capping position 12A to the capping standby position 12B, the cap 12 separates from the fluid nozzle faces 31*a* and the fluid nozzle faces 31*a* are not covered by the cap 12. Because the wiper unit 26 descends and separates from the moisture discharge head 30 in conjunction with the descent of the unit frame 15, the valve switch 41 is pushed back by the urging force F1 of the spring 60 from the open position 41B to the closed position 41A. The valve unit 40 is therefore held closed when the fluid nozzle faces 31*a* are not covered by the cap 12.

Note that, as shown in the top in FIG. 6B, when the moisture discharge head 30 is at the maintenance position 5B, the wiper unit 26 is set to a position away from the pushing position 26C, and the unit frame 15 rises until the cap 12 reaches the capping position 12A, the protruding part 70 of the wiper unit 26 that rises with the unit frame 15 does not contact the valve switch 41 as shown in the bottom in FIG. 6B, and the valve switch 41 is not depressed. The fluid nozzle faces 31*a* are thus sealed by the cap 12 while the valve unit 40 remains closed. In this embodiment the wiper unit 26 is moved to the second engagement position 26B when the wiper unit 26 is set to a position away from the pushing position 26C.

Inkjet Head Maintenance Operation and Moisture Supply Operation

Figure 7:
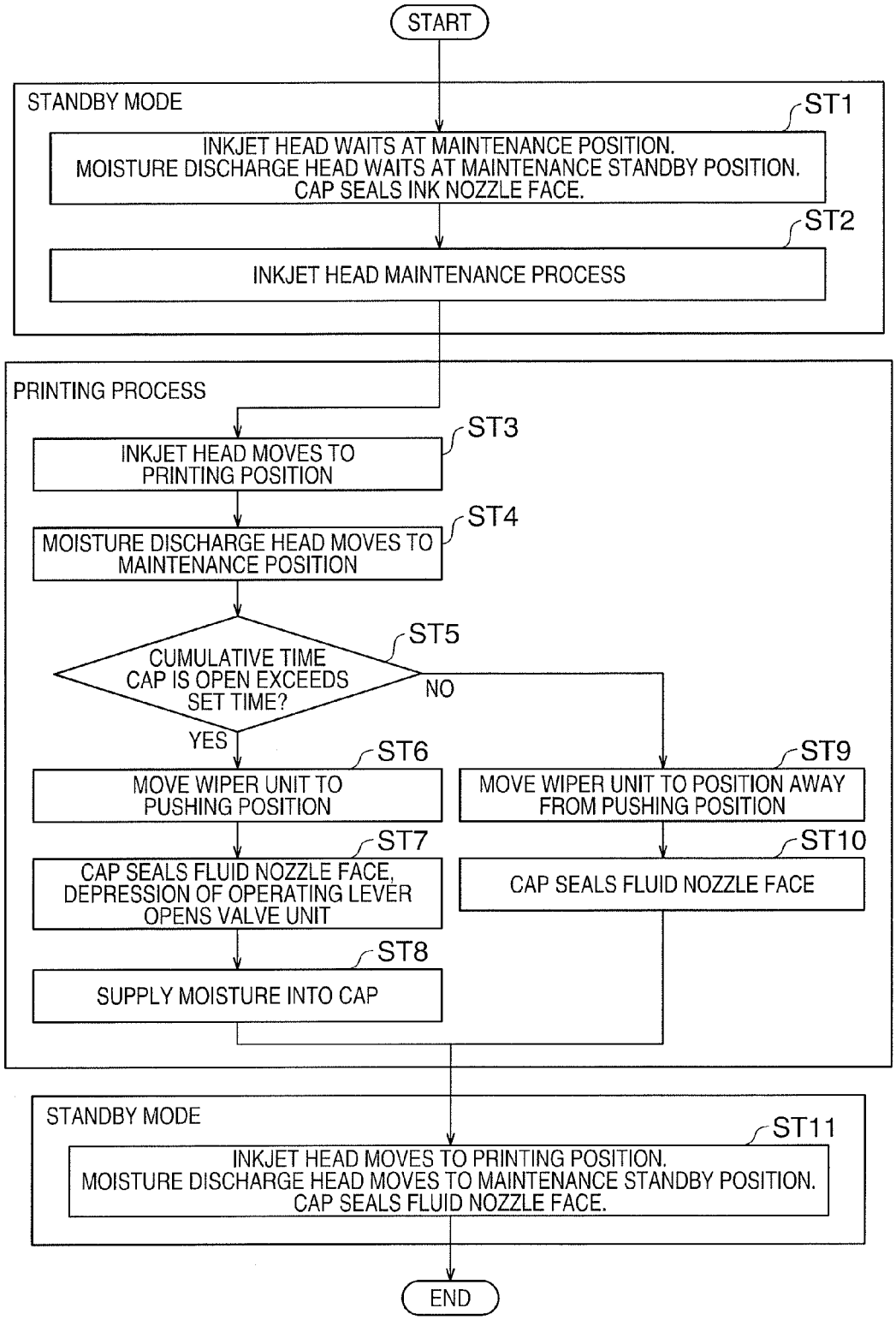
FIG. 7 is a flow chart of the moisture supply operation.

FIG. 7 is a flow chart of the inkjet head 5 maintenance operation and the operation supplying moisture to the cap 12. When the inkjet printer 1 is in the standby mode, the inkjet head 5 is at the maintenance position 5B, and the moisture discharge head 30 is at the maintenance standby position. The cap 12 is disposed to the capping position 12A, and seals the ink nozzle faces 7 of the inkjet head 5 (step ST1). Evaporation of moisture from the ink nozzles is suppressed by sealing the ink nozzle faces 7 with the cap 12.

The inkjet head 5 maintenance operation is performed when the inkjet printer 1 is in the standby mode, and the flushing operation that discharges ink from the inkjet head 5 into the cap 12 is performed at a specific time. If ink nozzle clogging is detected, the ink suction operation is performed, causing the suction pump 14 to produce negative pressure in the sealed space formed by the ink nozzle faces 7 and cap 12, forcibly purging ink from the inkjet head 5 into the cap 12. The ink nozzle faces 7 are also wiped by the wiper mechanism 13 at a specific time (step ST2).

When the inkjet printer 1 receives print data supplied from an external device, the lift mechanism 18 lowers the cap 12 from the capping position 12A to the capping standby position 12B where there is no interference with the inkjet head 5. When the cap 12 moves to the capping standby position 12B, the inkjet head 5 is set to the printing position 5A (step ST3). When at the printing position 5A, the inkjet head 5 can print to the recording paper 4 conveyed past the printing position P.

When the inkjet head 5 moves to the printing position 5A, the moisture discharge head moving mechanism 33 moves the moisture discharge head 30 to the maintenance position 5B (step ST4).

The inkjet printer 1 continuously counts the open time, that is, how long the ink nozzle faces 7 of the inkjet head 5 and the fluid nozzle faces 31*a* are not sealed by the cap 12, and determines if this cumulative open time exceeds a predetermined setting (step ST5).

If the cumulative open time exceeds the set time in step ST5, there is a low moisture state inside the cap due to evaporation, and the wiper unit moving mechanism 27 moves the wiper unit 26 to the pushing position 26C (step ST6). The lift mechanism 18 then raises the cap 12 from the capping standby position 12B to the capping position 12A. As a result, the protruding part 70 of the wiper unit 26 contacts the operating part 41*a* of the valve switch 41 as the cap 12 rises, and pushes the valve switch 41 from the closed position 41A in the depression direction D3 to the open position 41B, the fluid nozzle faces 31*a* are sealed by the cap 12, and the valve unit 40 opens (step ST7).

When the fluid nozzle faces 31*a* are sealed by the cap 12 and the valve unit 40 is open, the suction pump 14 operates. As a result, moisture is discharged from the fluid nozzles 31 into the cap 12. More specifically, moisture is supplied into the cap 12, and the balance of moisture to moisture in the cap 12 is adjusted (step ST8).

If in step ST5 the cumulative open time is not exceeded, the wiper unit moving mechanism 27 moves the wiper unit 26 away from the pushing position 26C to the second engagement position 26B (step ST9). The lift mechanism 18 then raises the cap 12 from the capping standby position 12B to the capping position 12A, and seals the fluid nozzle faces 31*a* with the cap 12 (step ST10). Because the protruding part 70 of the wiper unit 26 does not contact the valve switch 41 when the cap 12 rises in step ST10, the valve unit 40 is kept closed when the fluid nozzle faces 31*a* are sealed by the cap 12. When the fluid nozzle faces 31*a* are sealed by the cap 12, evaporation of moisture from the cap 12 is suppressed.

When printing the print data then ends, the inkjet printer 1 returns to the standby mode. More specifically, the lift mechanism 18 moves the cap 12 to the capping standby position 12B, and the moisture discharge head moving mechanism 33 moves the moisture discharge head 30 to the maintenance standby position 30A. When the inkjet head 5 then returns to the maintenance position 5B, the lift mechanism 18 moves the cap 12 to the capping position and seals the ink nozzle faces 7 of the inkjet head 5 (step ST11).

Effect of Operation

The valve unit 40 disposed to the moisture supply path 35 in this embodiment of the invention opens only when the valve operating mechanism 42 seals the fluid nozzle faces 31*a* of the moisture discharge head 30 with the cap 12, and is held closed when the fluid nozzle faces 31*a* are not sealed with the cap 12. As a result, leakage of moisture from the moisture discharge head 30, and backflow of moisture in the moisture supply path 35, can be prevented or reduced.

In addition, because the wiper unit 26 that moves together with the cap 12 operates the valve switch 41 that opens and closes the valve unit 40, the wiper unit 26 can perform an opening operation that opens the valve unit 40 in conjunction with moving the cap 12 to seal the moisture discharge head 30, and a closing operation that closes the valve unit 40 in conjunction with the cap 12 moving away from the moisture discharge head 30.

In addition, because the moisture discharge head moving mechanism 33 is rendered using the wiper unit moving mechanism 27 that moves the wiper unit 26 in this embodiment of the invention, the moisture discharge head moving mechanism 33 can be easily rendered and the cost of manufacturing the inkjet printer 1 can be suppressed.

Furthermore, because this embodiment uses the wiper unit 26 that can move on the unit frame 15 moved vertically by the lift mechanism 18 as the pushing member that depresses the valve switch 41, opening and closing the valve unit 40 can be controlled by the position of the wiper unit 26 when the cap 12 seals the fluid nozzle faces 31*a* of the moisture discharge head 30 at the maintenance position 5B.

Other Embodiments

The pushing member for depressing the valve switch 41 is the wiper unit 26 in the foregoing embodiment, but the invention is not limited to using the wiper unit 26, and any member that moves together with the cap 12 could be used as the pushing member. The pushing member could also be rendered in unison with the cap 12. In such configurations, however, the pushing member must push constantly on the valve switch 41 and hold the valve unit 40 open when the cap 12 moves away from the capping standby position 12B to the capping position 12A and seals the fluid nozzle faces 31*a* of the moisture discharge head 30 at the maintenance position 5B.

In addition, because the fluid nozzle faces 31*a* of the moisture discharge head 30 can be wiped by the wiper mechanism 13 at the maintenance position 5B, the fluid nozzle faces 31*a* could also be wiped by the wiper mechanism 13 after moisture is supplied through the moisture discharge head 30 into the cap 12. More specifically, the unit frame 15 rises to set the wiper mechanism 13 to the wiping position where the top edge of the wiper 25 can slide against the ink nozzle faces 7, and the wiper unit moving mechanism 27 moves the wiper unit 26 in the longitudinal direction to wipe the fluid nozzle faces 31*a* with the wiper 25. This can prevent moisture from dripping off the fluid nozzle faces 31*a*.

What is claimed is:

1. An inkjet printer, comprising:

an inkjet head configured to move between a printing position and a maintenance position;

an ink tank below the printing position and connected to the inkjet head;

a cap configured to seal an ink nozzle face of the inkjet head when the inkjet head is set to the maintenance position;

a cap moving mechanism configured to move the cap; and a moisture supply mechanism configured to supply a moisture to an internal space of the cap, wherein the moisture supply mechanism includes a moisture discharge head, different from the inkjet head, with a fluid nozzle face in which a fluid nozzle for discharging the moisture is formed, the moisture discharge head being configured to move between the maintenance position and a maintenance standby position that is different from the printing position, a valve disposed in a moisture supply path connecting a moisture tank with the fluid nozzle, and a valve operating mechanism configured to hold the valve closed when the fluid nozzle face is not covered by the cap and open the valve when the fluid nozzle face is sealed by the cap, the cap moving mechanism is configured to move the cap between a capping position sealing the ink nozzle face of the inkjet head set to the maintenance position or the fluid nozzle face of the moisture discharge head set to the maintenance position and a capping standby position removed from the capping position, and the valve operating mechanism is configured to hold the valve closed when the cap is at the capping standby position and open the valve when the cap is at the capping position.

2. The inkjet printer according to claim 1, wherein the moisture supply mechanism includes a moisture discharge head moving mechanism configured to move the moisture discharge head to the maintenance position when the inkjet head is at the printing position and seal the fluid nozzle face with the cap, and a suction mechanism configured to produce a negative pressure in a sealed space formed by the fluid nozzle face and the cap and discharge the moisture from the fluid nozzle when the fluid nozzle face is sealed by the cap and the valve is open.

3. The inkjet printer according to claim 1, wherein the valve operating mechanism includes a valve switch supported on the moisture discharge head slidably between a closed position for closing the valve and an open position for opening the valve, and a pushing member configured to, when the cap moves from the capping standby position to the capping position and approaches the moisture discharge head set to the maintenance position, approach the moisture discharge head with the cap and push the valve switch in a depression direction from the closed position to the open position.

4. The inkjet printer according to claim 3, wherein the valve operating mechanism includes a first spring member configured to support the valve switch at the closed position and urge the valve switch to the closed position side when the valve switch is pushed from the closed position to the open position, and when the cap moves from the capping position toward the capping standby position and the pushing member separates from the moisture discharge head, the valve switch is configured to be pushed back from the open position to the closed position by a first urging force of the first spring member.

5. The inkjet printer according to claim 4, wherein the valve includes a valve seat in which an orifice for opening and closing the moisture supply path is disposable, a disc configured to move in a direction toward and a direction away from the valve seat and open and close the orifice, a second spring member configured to urge the disc to the valve seat, and a magnetic attraction mechanism configured to move the disc in a direction away from the valve seat against a second urging force of the second spring member, the magnetic attraction mechanism includes a magnetic body and a magnet, one of the magnetic body and the magnet mounted on the disc and the other of the magnetic body and magnet mounted the valve switch, and when the valve switch is depressed to the open position, the magnet and magnetic body are configured to approach, so that a force of magnetic attraction working between the magnet and magnetic body separates the disc from the valve seat and opens the orifice, and when the valve switch moves from the open position to the closed position, the second urging force of the second spring member seats the disc on the valve seat and closes the orifice.

6. The inkjet printer according to claim 3, further comprising:

a wiper unit with a wiper configured to wipe the ink nozzle face of the inkjet head at the maintenance position or the fluid nozzle face of the moisture discharge head at the maintenance position;

a wiper unit configured to move a mechanism configured to move the wiper unit parallel to the ink nozzle face or the fluid nozzle face; and a linking mechanism configured to link the wiper unit and the moisture discharge head, wherein the moisture discharge head moving mechanism is configured to move the moisture discharge head between the maintenance position and the maintenance standby position by moving the wiper unit while the wiper unit and the moisture discharge head are linked by the linking mechanism.

7. The inkjet printer according to claim 6, further comprising:

a frame on which the cap, wiper unit, and wiper unit moving mechanism are mountable, wherein the cap moving mechanism is configured to move the cap between the capping position and the capping standby position by moving the frame, and the pushing member includes the wiper unit configured to move with the cap, the pushing member being configured to depress the valve switch when the wiper unit is set to a specific pushing position by the wiper unit moving mechanism.

8. An inkjet printer, comprising:

an inkjet head configured to move between a printing position and a maintenance position;

a cap configured to seal an ink nozzle face of the inkjet head when the inkjet head is set to the maintenance position;

a cap moving mechanism configured to move the cap; and a moisture supply mechanism configured to supply a moisture to an internal space of the cap and including a moisture discharge head with a fluid nozzle face in which a fluid nozzle for discharging the moisture is formed, a valve disposed in a moisture supply path connecting a moisture tank with the fluid nozzle, and a valve operating mechanism configured to hold the valve closed when the fluid nozzle face is not covered by the cap and open the valve when the fluid nozzle face is sealed by the cap, wherein the cap moving mechanism is configured to move the cap between a capping position sealing the ink nozzle face of the inkjet head set to the maintenance position or the fluid nozzle face of the moisture discharge head set to the maintenance position and a capping standby position removed from the capping position, the valve operating mechanism is configured to hold the valve closed when the cap is at the capping standby position and open the valve when the cap is at the capping position, and the moisture supply mechanism further includes a moisture discharge head moving mechanism configured to move the moisture discharge head to the maintenance position when the inkjet head is at the printing position and seal the fluid nozzle face with the cap, and a suction mechanism configured to produce a negative pressure in a sealed space formed by the fluid nozzle face and the cap and discharge moisture from the fluid nozzle when the fluid nozzle face is sealed by the cap and the valve is open.

9. An inkjet printer, comprising:

an inkjet head configured to move between a printing position and a maintenance position;

a cap configured to seal an ink nozzle face of the inkjet head when the inkjet head is set to the maintenance position;

a cap moving mechanism configured to move the cap;

a moisture supply mechanism configured to supply a moisture to an internal space of the cap and including a moisture discharge head with a fluid nozzle face in which a fluid nozzle for discharging the moisture is formed, a valve disposed in a moisture supply path connecting a moisture tank with the fluid nozzle, and a valve operating mechanism configured to hold the valve closed when the fluid nozzle face is not covered by the cap and open the valve when the fluid nozzle face is sealed by the cap, wherein the cap moving mechanism is configured to move the cap between a capping position sealing the ink nozzle face of the inkjet head set to the maintenance position or the fluid nozzle face of the moisture discharge head set to the maintenance position and a capping standby position removed from the capping position, the valve operating mechanism is configured to hold the valve closed when the cap is at the capping standby position and open the valve when the cap is at the capping position, the valve operating mechanism includes a valve switch supported on the moisture discharge head slidably between a closed position for closing the valve and an open position for opening the valve, and a pushing member configured to, when the cap moves from the capping standby position to the capping position and approaches the moisture discharge head set to the maintenance position, approach the moisture discharge head with the cap and push the valve switch in a depression direction from the closed position to the open position;

a wiper unit with a wiper configured to wipe the ink nozzle face of the inkjet head at the maintenance position or the fluid nozzle face of the moisture discharge head at the maintenance position;

a wiper unit configured to move a mechanism configured to move the wiper unit parallel to the ink nozzle face or the fluid nozzle face; and a linking mechanism configured to link the wiper unit and the moisture discharge head, wherein the moisture discharge head moving mechanism is configured to move the moisture discharge head between the maintenance position and a maintenance standby position separated from the maintenance position by moving the wiper unit while the wiper unit and the moisture discharge head are linked by the linking mechanism.

* * * * *